US008708039B2

(12) United States Patent
Wilson

(10) Patent No.: US 8,708,039 B2
(45) Date of Patent: Apr. 29, 2014

(54) PRODUCING GAS AND LIQUID FROM BELOW A PERMANENT PACKER IN A HYDROCARBON WELL

(75) Inventor: Dennis R. Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 425 days.

(21) Appl. No.: 12/894,991

(22) Filed: Sep. 30, 2010

(65) Prior Publication Data

US 2011/0073318 A1 Mar. 31, 2011

Related U.S. Application Data

(60) Provisional application No. 61/247,386, filed on Sep. 30, 2009, provisional application No. 61/247,331, filed on Sep. 30, 2009.

(51) Int. Cl.
*E21B 43/00* (2006.01)
*F04B 53/00* (2006.01)

(52) U.S. Cl.
USPC ..... 166/105.2; 166/106; 166/369; 417/555.2

(58) Field of Classification Search
USPC ..... 166/105, 105.2, 106, 369; 417/554, 417/555.1, 555.2
See application file for complete search history.

(56) References Cited

U.S. PATENT DOCUMENTS

| | | | | | |
|---|---|---|---|---|---|
| 2,217,305 | A * | 10/1940 | Bryan | 417/117 |
| 2,797,642 | A * | 7/1957 | Bloudoff | 166/54.1 |
| 3,074,352 | A | 1/1963 | Vincent | |
| 3,084,630 | A | 4/1963 | Massey | |
| 3,912,420 | A * | 10/1975 | Gault | 417/260 |
| 4,219,311 | A * | 8/1980 | Simon | 417/260 |
| 4,643,258 | A * | 2/1987 | Kime | 166/369 |
| 6,273,690 | B1 * | 8/2001 | Fischer et al. | 417/555.2 |
| 7,458,787 | B2 * | 12/2008 | Brown | 417/555.2 |
| 8,256,504 | B2 * | 9/2012 | Brown | 166/68 |
| 2004/0202521 | A1 | 10/2004 | Bostik | |
| 2006/0169458 | A1 | 8/2006 | Jones, Jr. | |
| 2007/0253848 | A1 | 11/2007 | Lea, Jr. | |
| 2008/0066901 | A1 | 3/2008 | Gereluk | |
| 2008/0314581 | A1 * | 12/2008 | Brown | 166/105 |

* cited by examiner

*Primary Examiner* — Shane Bomar
*Assistant Examiner* — Catherine Loikith
(74) *Attorney, Agent, or Firm* — ConocoPhillips Company

(57) ABSTRACT

The invention relates to an arrangement for positively pumping liquids to the surface of a hydrocarbon well where the hydrocarbon well has bee previously completed with a permanent packer and tailpipe. A rod pump having a plunger connected to a hollow rod string can positively pump the liquids collecting at the bottom of the well while the natural gas is produced up the annulus between the production tubing and the hollow rod string. In this invention, the tail pipe is perforated above the rod pump and below the packer to all the natural gas into the production tubing.

6 Claims, 2 Drawing Sheets

PRODUCING GAS AND LIQUID FROM BELOW A PERMANENT PACKER IN A HYDROCARBON WELL

CROSS-REFERENCE TO RELATED APPLICATIONS

This application is a non-provisional application which claims benefit under 35 USC §119(e) to U.S. Provisional Application Ser. No. 61/247,386 filed Sep. 30, 2009, entitled "Producing Gas and Liquid from Below a Permanent Packer in a Hydrocarbon Well," and also to U.S. Provisional Application Ser. No. 61/247,331 filed Sep. 30, 2009, entitled "Double String Pump for Hydrocarbon Wells," both of which are incorporated herein in their entirety.

STATEMENT REGARDING FEDERALLY SPONSORED RESEARCH OR DEVELOPMENT

None.

FIELD OF THE INVENTION

This invention relates to pumping liquids from hydrocarbon wells that are producing natural gas.

BACKGROUND OF THE INVENTION

It is common to drill a well seeking hydrocarbons and to set a permanent packer with a tailpipe hanging from the packer down inside casing. Such an arrangement provides access to natural gas where the formation is under high pressure. High gas productivity provides flow rates that are able to carry liquids to the wellhead and avoid issues of liquid resistance. Also, high gas productivity is often desired for high monetization of the gas from the well and create high cash flow for the owner of the hydrocarbon resource. However, eventually such wells mature and flow rates diminish to the point where the natural flow is unable to carry the liquids out of the well. In these circumstances where gas production is already diminishing, liquids in the well create additional problems by substantially diminishing or restricting gas production. Such wells continue to produce gas in "bubble flow" where it is readily apparent that removing the water column would significantly enhance gas recovery and productivity rates.

While many procedures are known for extending the life and productivity of such wells, eventually such wells are plugged and abandoned because the gas flow is diminished to a trickle. With a permanent packer in place to handle the original high pressures of the well, installing a pump is impractical. Some might consider milling out the permanent packer, but milling requires cooling lubricant that inherently exaggerates the problem of too much liquid at the bottom of the well and permanently choking down the gas flow from the formation.

Some have installed coiled tubing down inside the production tubing where the coiled tubing has a much smaller diameter than the tail pipe. With a smaller diameter, the same gas productivity in the well will flow upwardly through the coiled tubing at a faster rate and keep the liquids entrained with the gas. While this is likely to extend the life of the well, a positive displacement pump will allow for more gas recovery and liquids recovery than even the smallest diameter tube operating in an artificial lift scenario.

SUMMARY OF THE INVENTION

The invention more particularly relates to a system for producing liquids from a gas well having a permanent packer and a tailpipe installed in the natural gas well where the system includes a pump having a barrel and a plunger wherein the barrel is connected to the production tubing at a connection near the lower end thereof and the plunger is arranged for up and down pumping movement within the barrel. The system includes holes in the tailpipe above the connection of the barrel to the production tubing and a string of hollow valve rod connected to the plunger and in fluid communication therewith to carry liquids drawn into the plunger during the movement of the plunger up and down within the barrel.

In a preferable arrangement, the system includes check valves within the hollow valve rod to prevent particles that might settle in liquid from descending below the check valves and maintaining the particles at a level in the wellbore closer to the surface so that when the pump is operating, the particles are pushed closer and closer to the surface to eventually be fully removed from the well.

The invention also relates to a process for producing liquids from a cased natural gas well where the natural gas well has perforations in casing to produce gas and liquids, a permanent packer and a tailpipe installed therein wherein the process includes installing holes in the tailpipe generally at or above the level of the perforations in the casing and then installing a pump at the end of a string of hollow valve rod where the pump includes a barrel and a hollow plunger and where the hollow plunger is connected to and in fluid communication with the hollow valve rod and further includes a traveling valve to admit liquids into the hollow interior of the plunger and wherein the barrel connects to the tailpipe below the holes installed in the tailpipe in step a) and includes a standing valve to admit liquids into the barrel. Then plunger is raised and lowered, repetitively, to draw liquids through the standing valve and through the traveling valve and eventually into the hollow valve rod.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

Figure 1:
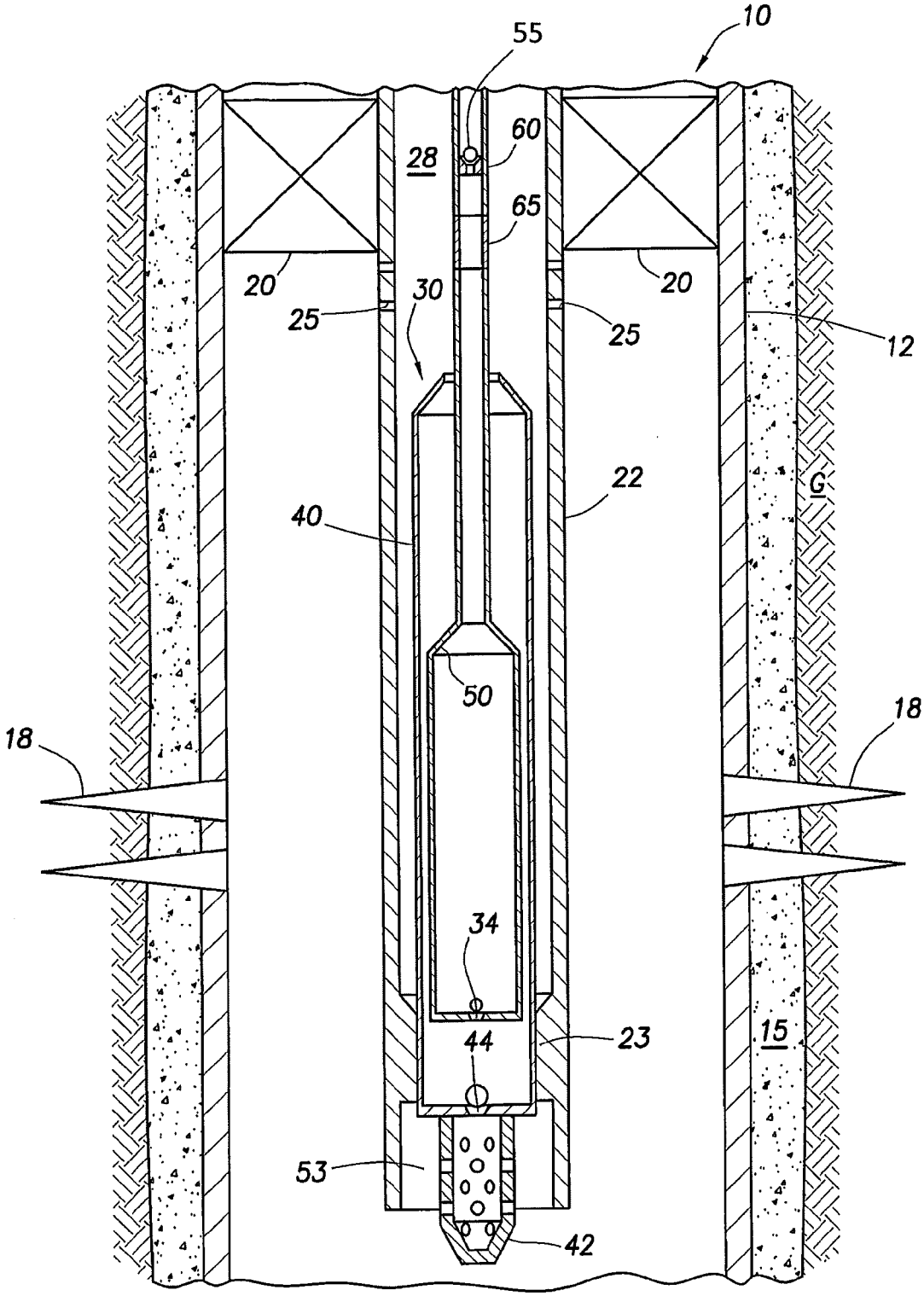
FIG. 1 is a cross section of a converted wellbore with a permanent packer and tailpipe with a pump arrangement of the present invention to produce both liquids and gas where the gas production is not sufficient to carry entrained liquids to the surface.

In FIG. 1, a wellbore, generally indicated by the arrow 10, is shown formed or drilled into the ground G. According to conventional procedures, casing 12 has been inserted into the wellbore and sealed against the wall of the wellbore with cement 15 whereafter perforations 18 have been punched through the casing 12 and through the cement 15 and into a hydrocarbon-bearing formation in the ground G by explosive charges.

In the present situation, the hydrocarbon bearing formation may have been at very high pressure when initially accessed and precautions had to be taken to maintain well control. With very high pressure, a permanent packer 20 is installed with tailpipe 22 hanging below the permanent packer 20. The natural gas being produced from the formation would have entered the bottom of the tailpipe 22 and, by standard convention, travelled up the tailpipe 22 into production tubing (not shown) that is stung or connected into the top of the permanent packer 20 in fluid communication with the tailpipe 22. After the formation has become somewhat depleted and gas rates have diminished, less and less liquids are being entrained in the gas flow. As a result, liquids collect at the bottom of the wellbore 10.

By the present invention the completion is changed to positive displacement pump 30 to positively evacuate the liquids that are collected at the bottom of the wellbore 10 and convey such liquids to the surface. Before the rod pump, generally indicated by arrow 30, is installed into the tail pipe 22, holes 25 are created in the tailpipe just below the permanent packer 20. These holes will be used to allow natural gas to proceed up the tailpipe 22 and into production tubing without being impeded by liquids. They may be created by detonating a shaped charge or by other mechanical means for making perforations or holes in the side of pipe while downhole as is known in the art.

After the holes 25 are created, the rod pump 30 is installed into the tailpipe 22 using a nipple 23 in the tailpipe 22. The nipple 23 is a common feature in such wells in that they are used for plugs when the wellbore 10 was originally completed. With a sealing surface, either the barrel 40 of the pump 30 is seated into the nipple 23 of the tail pipe 22 with a suitable sealing arrangement (not shown) or a hollow sub attached to the barrel 40 and suited for engaging nipple 23 is installed in a sealing arrangement with the nipple 23. Plunger 50 is arranged to move up and down within the barrel 40 by movement of string of hollow valve rod 60.

Figure 2:
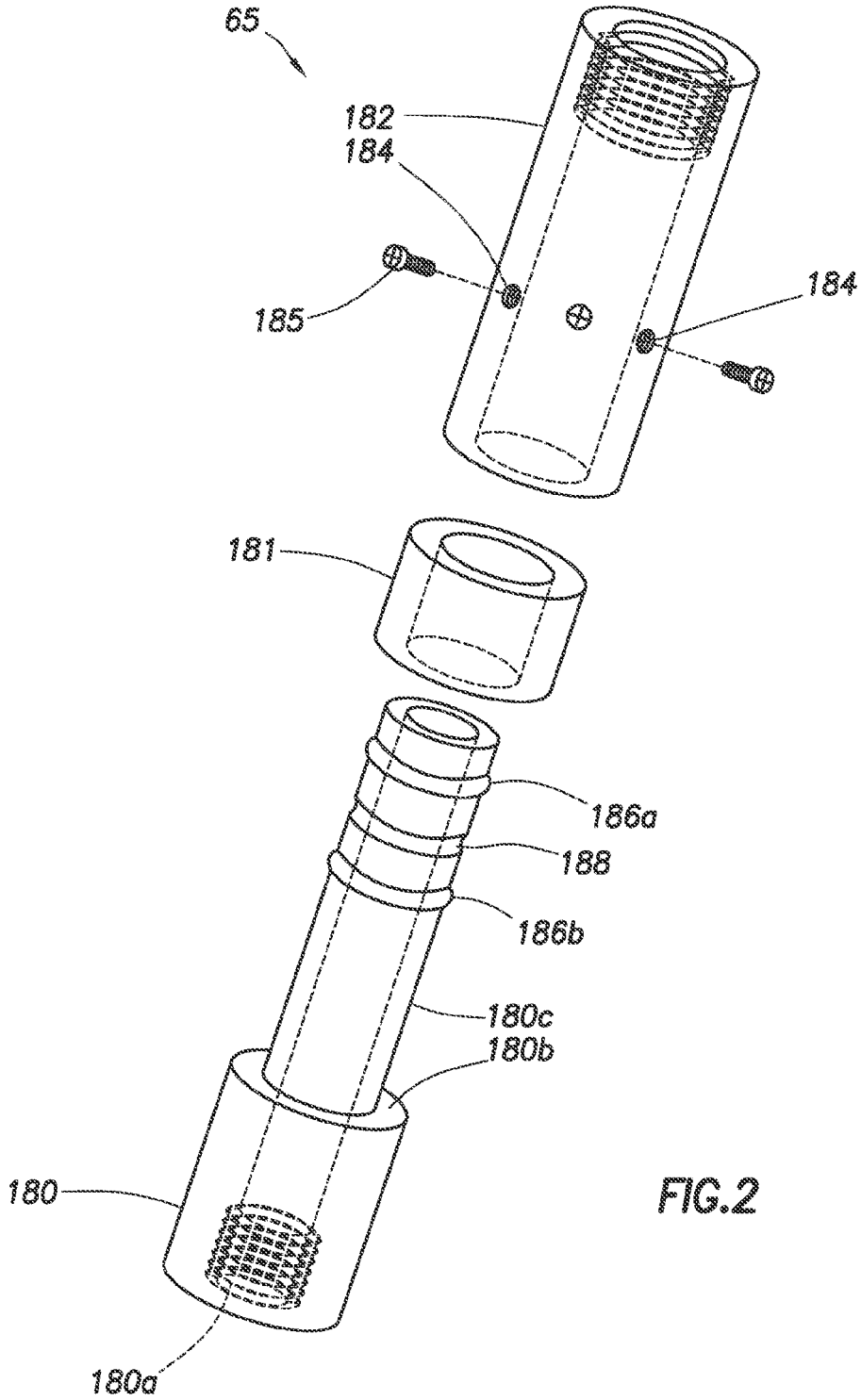
FIG. 2 is an exploded perspective view of a hollow shear tool for providing preferred breakaway for the production system of the present invention.

Hollow valve rod 60 is connected to plunger 50 by a hollow shear tool 65 which will be more clearly explained when referring to FIG. 2. Hollow shear tool 65 provides a "weakest link" connection for the production system in the event the pump 30 needs to be pulled and corrosion or scaling has locked the barrel 40 to the nipple 23. The hollow shear tool 65 is designed to break away in a manner that fishing tools and high strength wireline or other fishing technology may grab on to the remaining equipment and pull it out of the wellbore 10.

Below the barrel 40 is a strainer nipple 42 having a number of holes to allow liquids or gas that is in the quiet zone 53 to pass into the barrel through standing valve 44. Standing valve 44 is shown to be a ball and seat, but may be any suitable one-way valve technology. As the plunger 50 is lifted relative to the barrel 40, liquids are drawn up through the strainer nipple 42 and through standing valve 44 to fill the space in the barrel 40 below the plunger 50. The plunger 50 includes a travelling valve 34, that like the standing valve 44, is shown as a ball and seat, but may be any suitable one-way valve technology. As the plunger 50 is lowered in the barrel 40, standing valve 44 closes to keep liquid in the barrel but unseat the travelling valve 34 so that the liquids in the barrel below the plunger 50 enter and flow into hollow inside of the plunger 50. Liquids that were already in the plunger 50 before the plunger began its downward movement in the barrel 40 exit through the top of the plunger 50 through the hollow valve rod 60.

Hollow valve rod 60 includes a series of check valves 55 to prevent liquids from draining back down to the plunger 50. A check valve 55 may be a ball and seat as shown, but other one-way valve technology may also suffice. The check valves are spaced apart in the hollow valve rod 60 so that liquid pumped up the hollow valve rod passes at least one check valve 55 during each pump cycle. Any sand or particulates are intended to be carried with the liquid and the check valves 55 are intended to prevent such solids from settling below the last check valve during periods where the pump 30 is idle. The small diameter, and therefore a higher velocity flow rate would help entrain the solids with the liquid. Ideally, by calculating the wellbore volume that liquid will be allowed to occupy and by spacing the check valves or ball checks within the string so that the volume between them does not exceed a pumping cycle volume then each operating cycle would cause the particles to pass through at least one check valve. Again, with the smaller diameter in the production path up through the hollow valve rod 60, the pump rate can set at or above the lift velocity required for the well and re-entrainment of the solids into the liquid flow should be quicker and more certain.

In operation, pump 30 operates intermittently to lift liquids out of the bottom of the wellbore 10 so that hydrocarbon production is optimized. A number of operation schemes can be employed, but typically, the pump 30 is started based on elapsed time from the most recent pump operation cycle and continues until a reduced weight of the plunger 50 is detected, meaning that the liquids at the bottom of the well are reduced and that the pump 30 has had a gas break through.

The pump 30 preferably maintains the liquid level within the wellbore 10 below the perforations 18. Natural gas entering the wellbore 10 from the formation is allowed to pass up the inside of the casing 12 until the permanent packer 20 and pass through holes 25 and then pass up annulus 28 to the surface. Two production paths are then created where gas progresses up the annulus 28 while liquids and any entrained solids pass up through the hollow valve rod 60.

Turning now to FIG. 2, the hollow shear tool 65 will be explained. The hollow shear tool 65 comprises three segments. Base segment 180 includes screw threads 180*a* to attach to the plunger 50 with ring segment 181 overlying the upper, smaller diameter portion 180*c* of base segment 180. The ring segment slides down smaller diameter portion 180*c* until it contacts shoulder 180*b*. Breakaway segment 182 also slides over smaller the diameter portion 180*c* until holes 184 generally align with groove 188 in smaller diameter portion 180*c*. Breakaway segment 182, like base segment 180 includes screw threads that are arranged to attach to the hollow valve rod 60. O-rings 186*a* and 186*b* are provided to seal the hollow interior passageway from the outside of hollow shear tool 65. With a preselected number of screws screwed into holes 184 and into groove 188, a predetermined breakaway strength can be provided so that when a tension between the hollow valve rod 60 and plunger 50 exceeds the predetermined breakaway strength, the breakaway portion 182 will separate from the base portion. The predetermined breakaway strength may be easily tested using conventional machine shop stools such as a press and pressure gauge by removing ring segment 181 and inserting a number of screws 185 and applying compression force until the screws break. The screws 185, in the arrangement of the hollow shear tool, should provide the same breakaway strength in compression and tension. The inventor expects that breakaway strengths of roughly 10,000 pounds or 15,000 pounds may be achieved and using stronger or weaker materials would expand the capacity range of such an arrangement. Clearly, the ease at which the breakaway strength may be successively measured should provide confidence in the actual breakaway strength. Screw holes that are not used are preferably blinded off to reduce the possibility of leaking.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A system for producing liquids from a gas well having a permanent packer and a tailpipe installed in the natural gas well where the system comprises:

a) a pump comprising a barrel and a plunger, wherein the barrel is seated in and connected to the tailpipe, wherein the barrel is seated and connected near the lower end of the tailpipe, wherein the plunger is arranged for up and down pumping movement within the barrel;

b) holes in the tailpipe above the connection of the barrel to the tailpipe, wherein the holes allow gas to proceed up the tailpipe and to the surface; and c) a string of hollow valve rod connected to the plunger and in fluid communication therewith, wherein the liquids drawn into the plunger during movement of the plunger up and down within the barrel exit the top of the plunger through the hollow valve rod, wherein the hollow valve rod includes a series of one-way valves to prevent particles that might settle in the liquid from descending below the one way valves, wherein the series of one-way valves are spaced apart so that liquids pumped up the hollow valve rod passes at least one one-way valve during each pump cycle.

2. The system according to claim 1 further including check valves within the hollow valve rod to prevent particles that might settle in liquid from descending below the check valves and maintaining particles at a level in the well closer to the surface so that when the pump is operating, the particles are pushed closer and closer to the surface to eventually be fully removed from the well.

3. The system according to claim 1 wherein the string of hollow valve rod is connected to the plunger by a hollow shear tool and wherein the hollow shear tool is constructed to break away from the plunger under tension and at a tension at which any segment of the hollow valve string would be expected to break.

4. A process for producing liquids from a cased natural gas well where the natural gas well has perforations in casing to produce gas and liquids, a permanent packer and a tailpipe installed therein wherein the process comprises:

a) installing holes in the tailpipe generally at or above the level of the perforations in the casing, wherein the holes allow gas to proceed up the tailpipe and to the surface;

b) installing a pump at the end of a string of hollow valve rod where the pump includes a barrel and a hollow plunger and where the hollow plunger is connected to and in fluid communication with the hollow valve rod and further includes a traveling valve to admit liquids into the hollow interior of the plunger and wherein the barrel connects to the tailpipe below the holes installed in the tailpipe in step a) and includes a standing valve to admit liquids into the barrel; and c) raising and lowering the plunger to draw liquids through the standing valve to fill the space in the barrel below the plunger and through the traveling valve to fill the plunger and direct the liquids to exit the top of the plunger into the hollow valve rod, wherein the hollow valve rod includes a series of one-way valves to prevent particles that might settle in the liquid from descending below the one way valves, wherein the series of one-way valves are spaced apart so that liquids pumped up the hollow valve rod passes at least one one-way valve during each pump cycle .

5. The process according to claim 4 further including the step of preventing back flow in the hollow valve rod by check valves to prevent particles that might settle in liquid from descending below the check valves and maintaining particles at a level in the well closer to the surface so that when the pump is operating, the particles are pushed closer and closer to the surface to eventually be fully removed from the well.

6. The process according to claim 4 further including producing natural gas through the holes in the tailpipe and to the surface while the liquids are conveyed to the surface in the hollow valve rod.

* * * * *